United States Patent [19]

Gasaway

[11] Patent Number: 4,458,897

[45] Date of Patent: Jul. 10, 1984

[54] COIN CONTROLLED SUPPORT FOR GAME NET

[75] Inventor: Jack S. Gasaway, Newport Beach, Calif.

[73] Assignee: Tele-Post, Inc., Reno, Nev.

[21] Appl. No.: 174,017

[22] Filed: Aug. 23, 1971

[51] Int. Cl.[3] ..... A63B 69/00

[52] U.S. Cl. ..... 273/29 BC

[58] Field of Search ..... 273/29 BC

[56] References Cited

U.S. PATENT DOCUMENTS

| | | | |
|---|---|---|---|
| 1,998,454 | 4/1935 | Gordon | 273/29 BB |
| 2,159,633 | 5/1939 | Peterson | 273/29 BC |
| 2,884,252 | 4/1959 | Thompson | 273/55 R |
| 2,913,197 | 11/1959 | Fonden et al. | 273/29 BC |

FOREIGN PATENT DOCUMENTS

| | | | |
|---|---|---|---|
| 19270 | of 1896 | United Kingdom | 273/29 BD |
| 198967 | 6/1923 | United Kingdom | 273/29 BD |

*Primary Examiner*—Richard C. Pinkham
*Assistant Examiner*—T. Brown
*Attorney, Agent, or Firm*—Lyon & Lyon

[57] ABSTRACT

A coin controlled support for a game net in which an end of a net supporting line is raised by a telescopic post operated by a lift mechanism and held elevated by a time controlled latch. The posts are held in a raised position when a game is to be played and are automatically lowered at the command of a timing mechanism to indicate the end of the game.

18 Claims, 5 Drawing Figures

COIN CONTROLLED SUPPORT FOR GAME NET

BACKGROUND OF THE INVENTION

Large numbers of persons who are interested in playing at sports of the type employing a net, say, for example, tennis, volley ball, or the like, make use of public facilities or group owned and operated facilities. The upkeep of the facilities and maintenance of the net is born by the public and by the group, and frequently no satisfactory system exists whereby the player contributes to such upkeep and maintenance.

More particularly, a number of tennis courts on public school grounds and in public parks may require costly repairs and maintenance paid for by local taxes without regard to whether the taxpayer is a user of the public facility. Thus, there has been a need for an effective means to collect use fees for such facilities where they are being used by the public to aid in offsetting the total cost of installing and maintaining the facilities.

Such games as tennis and volley ball involve the use of a net which is usually fixed at a regulation height, but if the net is high or low with respect to the regulation height, normal play cannot take place.

SUMMARY OF THE INVENTION

The present invention contemplates a coin controlled suport for such game nets, whereby the net may be adjusted to a proper elevation and held at such elevation for a period of time determined by the fee paid by the user or users of the facility, whereby to produce revenue related to use of the facility, the net automatically shifting to a different elevation at the expiration of the period of time paid for so that normal play must be discontinued unless payment is made for additional use.

With such a support in use on the playing courts of public facilities, the cost of upkeep and maintenance will be more equitably born by specific users rather than taxpayers in general.

More specifically, the invention contemplates a telescopic post adapted to support an end of a game net so that that end of the net is movable between a first playing position and a second non-playing position. Under the control of a timed lock or latch operable by coins, the net may be maintained in the playing position for a period of time and will then automatically move to the non-playing position.

In accomplishing the foregoing, the usual cable or line which supports the net is connected at one end to a vertically shiftable post which is adapted to be actuated to a first or playing position and to be retained in that position for the period of time paid for by the player or players. At the end of the period of time paid for, the post moves to the second position. While various actuator means for moving the post may be employed, the post is preferably gear driven from a lower position to an elevated position for play and the gear drive is locked for a time determined by a coin operated timer, so that upon expiration of the time paid for the post will descend to the non-playing position.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense, since the scope of the invention is best defined by the appended claims.

DESCRIPTION OF THE PREFERRED EMBODIMENT

Figure 1:
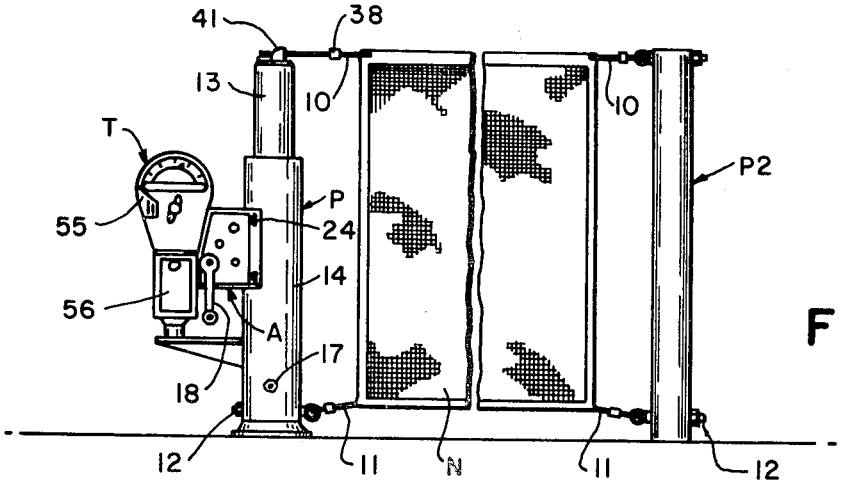
FIG. 1 is an elevation showing the invention applied to a tennis court.

As seen in the drawings, the illustrative embodiment of the invention is applied to a tennis net N stretched between a first post P, made in accordance with the invention and a second typical post P2. As customary, the net N is supported by cables 10 and is pulled down taught by cables 11 at the upper and lower corners of the net, such cables 10 and 11 being suitably connected to the posts, in the case of the typical tennis court, by means of eye bolts 12, or the like, but in the case of the connection of the upper net corner to the post P of the invention, by means later to be described whereby the upper edge of the net may be lowered at the post P so that the net sags to a non-playing position.

The post P is telescopic and includes an upper, inner post section 13 vertically telescopically disposed in a lower, outer post section 14. The post section 14 is suitably supported in an upright position, and in the illustrated embodiment, the lower end of the post section 14 is disposed on an inverted cup-like base which is placed over the upper end 16 of a portion of a typical post which has been embedded in the court and cut off to accommodate the inverted cup 15. Suitable through bolts 17 hold the post 14 and the cup 15 in assembly with the post end 16. Clearly, for new installations, the post 14 may be initially embedded in the court, if desired. In any event, the post 14 should be rigidly supported so that the net N will be properly tensioned in the playing position.

Figure 2:
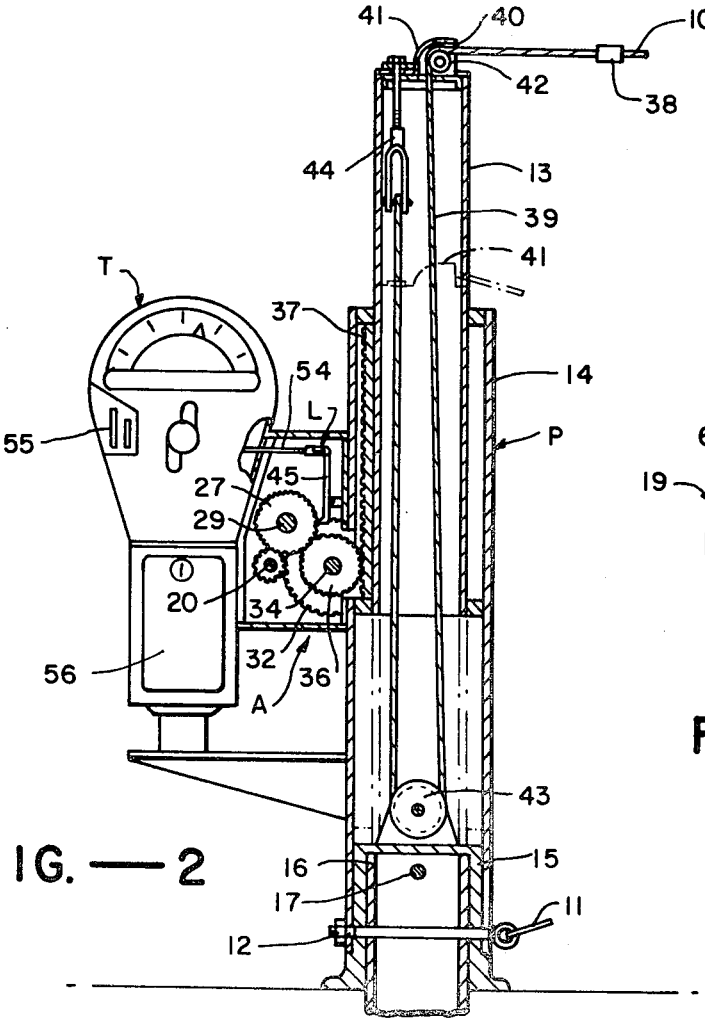
FIG. 2 is an enlarged view partly in elevation and partly in vertical section showing the net supported in the upper playing position in full lines and in broken lines in the lower non-playing position.

Means are provided at A for actuating the inner post 13 to the playing position shown in FIG. 1 and in full lines in FIG. 2, from the lower or non-playing position shown in broken lines in FIG. 2. In the illustrative embodiment, the means A comprises gear means adapted to be manually operated by a manual crank 18 connected by one-way clutch means 19 which will be later described, to a drive shaft 20 journalled in the opposing walls 21, 22 of a suitable housing, these side walls respectively being suitably attached to the post 14, as seen in FIG. 4, by fastenings 23 and 24.

Figure 4:
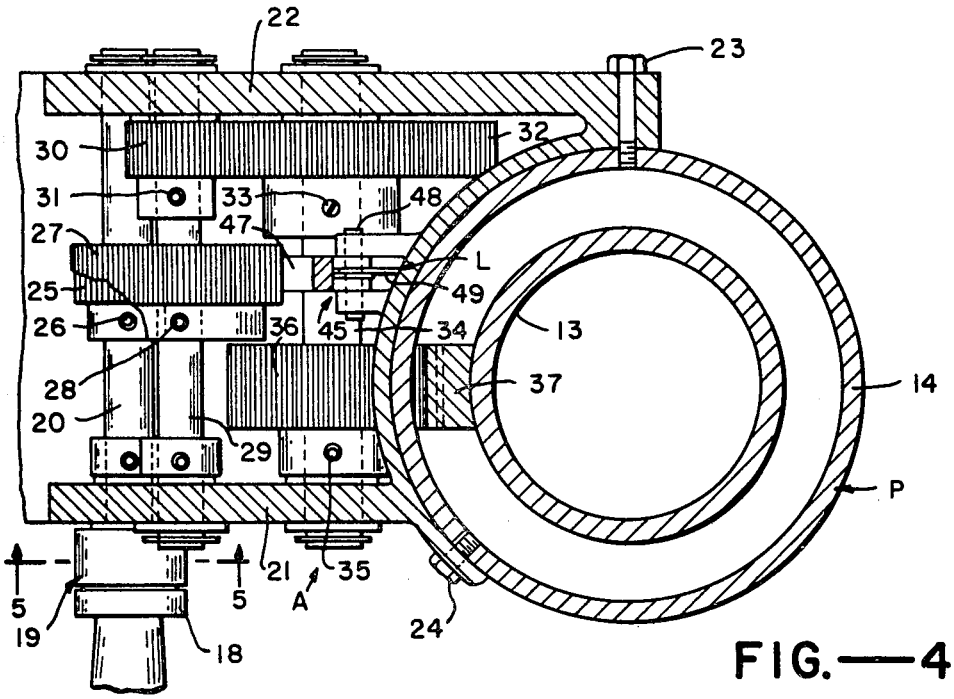
FIG. 4 is a horizontal section, as taken on the line 4—4 of FIG. 3.
Figure 3:
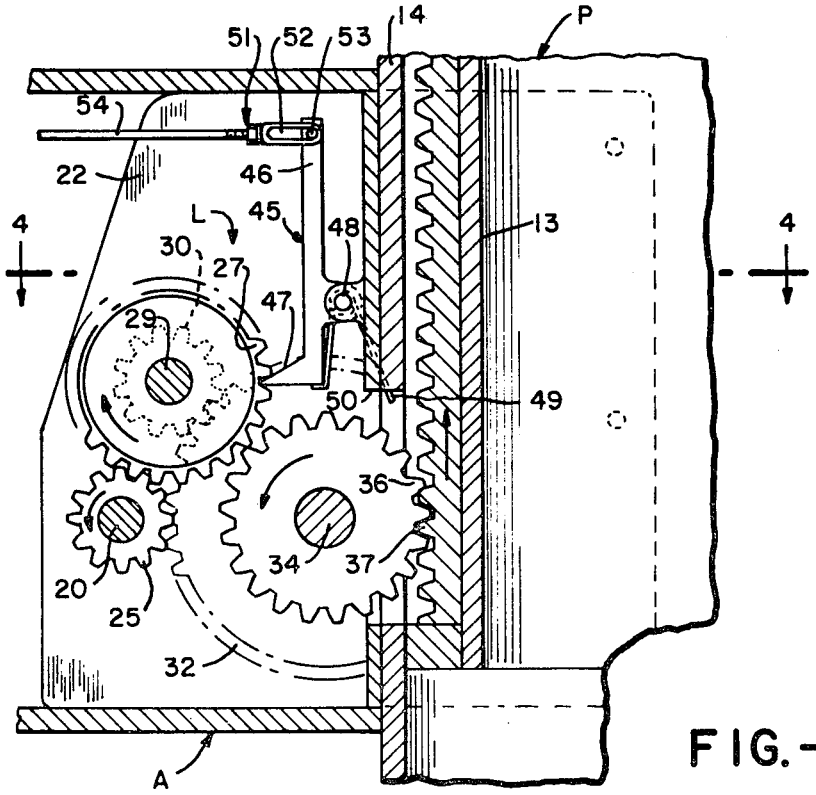
FIG. 3 is an enlarged fragmentary detail view in vertical section showing a gear drive for actuating the telescopic post and the latch means for holding the post in a playing position.

As best seen in FIGS. 3 and 4, the shaft 20 has a small gear 25 affixed by a screw 26 on the shaft 20 and in mesh with a large gear 27 which is affixed by a screw to a shaft 29 journalled in the housing side walls 21 and 22 in parallel relation to the drive shaft 20. Also on the shaft 29 is a small gear 30 secured by a screw 31, and in mesh with a large gear 32 which is fixed by a screw 33 on a final drive shaft 34 journalled in the housing side walls 21 and 22 in parallel relation to the shafts 20 and 29. Also fixed on the final drive shaft 34 by a screw 35 is a pinion 36 which meshes with a rack 37 extending longitudinally of the inner or upper post section 13. When the pinion 36 is driven through the gear system in a counter-clockwise direction, as seen in FIG. 4, to elevate the rack 37, the post 13 will be correspondly elevated, thereby elevating the net N, an upper connector cable 10 of which is connected at 38 to a cable 39 which is tensioned upon elevation of the inner post section 13 and which is relaxed upon lowering of the inner post section.

Referring to FIG. 2, the cable 39 will be seen to extend into the post section 13 through an opening 40 provided in a top closure or cap 41 on the post section 13. Suitably mounted in the opening 40 is a roller or sheave 42 over which the cable 39 passes, the cable extending downwardly through the upper post 13 and the lower post 14 and extending beneath another roller or sheave 43 which is suitably mounted for rotation on the cup member 15. The cable is anchored at its end to suitable adjuster means such as a screw clevis 44 whereby the tension on the net N can be adjusted, as may be necessary. The arrangement of the cable 39 and its rollers or sheaves 42 and 43 is such that a comparatively short vertical stroke of the inner post results in a doubling, for practical purposes, of the extent of tensioning and relaxation of the net.

While a mechanical system has been illustrated as the preferred embodiment, it will be appreciated that hydraulic net tensioning means may be employed. In any event, means are provided for maintaining the net tensioned for a period of time, under the control of a coin controlled timer T adapted to operate latch means L which holds the net tensioned, in the illustrated embodiment, by holding the inner post 13 in an elevated position.

This latch means L comprises a pawl or dog 45 having an arm 46 and a holding finger 47. Between its ends, the pawl 45 is pivotally mounted at 48 and a spring 49 is carried by the pivot and engages the pawl adjacent the holding finger 47 and a suitable stop at 50 to normally bias the holding finger into engagement with the gear 27 on the intermediate gear shaft 29 to prevent rotation in a counter-clockwise direction, as seen in FIG. 3, and thereby to prevent rotation of the pinion 36 in the direction which allows downward movement of the inner post section 13.

Connected to the upper end of the pawl arm 46 by a connector 51 having a lost motion slot 52 and a pin 53 carried by the arm, is a pull rod 54 adapted to be pulled to the left as seen in FIGS. 2 and 3 by the timer T, to release the pawl 45 from engagement with the gear 27 at the expiration of a period of time determined by the coins inserted into the timer at 55. The details of the timer T are not germane to the invention and it may be the typical coin controlled meter having a locked coin box 56, all as well known.

Figure 5:
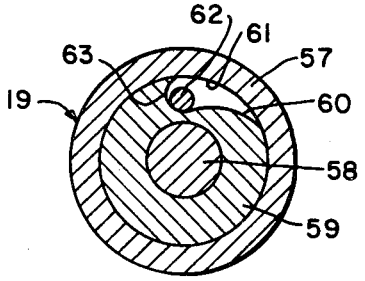
FIG. 5 is a vertical section, as taken on the line 5—5 of FIG. 4, showing a one way clutch between the gear drive and an operator crank.

As previously indicated, the crank 18, by which the inner post 13 is adapted to be actuated to its upper position, is connected to the drive shaft 20 by one-way clutch means of any suitable type, such as, for example, the clutch generally illustrated in FIG. 5. This clutch comprises an outer cup or body 57 which is affixed to the shaft 20 by a shoulder bolt 58 so as to rotate as a unit. This bolt 58 also holds the crank arm 18 in the assembly for rotation relative to the cup. On the arm 18 and extending into the cup 57 is the clutch driver 59 having a ramp surface 60 diverging from the inner annular wall 61 of the cup 57. The wedge angle of the surfaces 60 and 61 is such that when the driver 59 is rotated in one direction, a clutch roller 62 will engage between these surfaces to transmit rotation from the driver to the driven member or cup 57, but the cup 57 will freely rotate relative to the driver 59 in the other direction, and the roller will be carried in a depression 63. Such one way clutches are well known and other clutches may be employed for the purpose of allowing the inner post 13 to descend when the latch means L are released, without turning the crank 18 and possibly causing injury.

In use, coins in a desired number are inserted into the timer T which allows the pull rod 54 to move from a retracted position to the position of FIG. 3, at which the pawl 45 is operable to engage the latching gear 27. The crank arm 18 can then be rotated to drive the pinion 36 whereby the rack 37 will elevate the inner post 13. The pawl 45 ratchets past the teeth of the gear 27 as permitted by the lost motion slot 52 in the connector 51, and the latch finger 47 is biased into latching relation to the gear 27 by the spring 49. As the post section 13 is elevated, the cable 39 is pulled into the post assembly and tensions the net N. Following a period of time determined by the coins inserted into the timer T, the timer pulls the rod 54 to release the pawl 45 from the lock gear 27 and holds the pawl 45 in the released position, thereby enabling the inner post 13 to descend to the broken line position of FIG. 2, at which the net N will be slack and substantially lower than when it is in a playing position. Since the pawl engages gear 27 and there is a gear reduction between the gear 27 and the pinion 36, at the gears 30 and 32, the load on the pawl is reduced, so that the pulling force applied to the rod 54 is minimized.

In the event that the net support is to be used on courts where continued use of the court without pay may be necessary, say, in the case of tennis, volleyball, or other courts which are on school grounds and are used by the students during school hours, means may be provided to maintain the net in the playing position. Such means may be incorporated in the timer, in the actuator mechanism, or otherwise.

I claim as my invention:

1. A support for a game net for use on a game court, said support including a post having a lower section adapted to be fixedly mounted on the court, an upper post section vertically telescopic with respect to said lower post section for movement between first and second positions, connector means carried by said upper post section and connectable to a game net for disposing said net in a playing position when said upper post section is in said first position and for disposing said net in a non-playing position when said upper post section is in said second position, actuator means carried by said lower post section and operable on said upper post section for moving said upper post section to said first position from said second position, releasable means for holding said upper post section in said first position, and coin controlled timer means for releasing said releasable means to allow movement of said upper post section to said second position, wherein the improvement in said support comprises:

said connector means including a cable connected to said upper post section, said cable extending laterally away from said upper post section at a vertical distance above said game court at said post, and said cable being connected to said upper post section for combined vertical displacement of the height of said cable at said post above said game court and for extension and retraction of said cable with respect to said upper post section upon telescoping thereof.

2. A support for a game net as defined in claim 1, and means for adjusting the tension on said cable.

3. A support for a game net for use on a game court, said support including a post having a lower section adapted to be fixedly mounted on the court, an upper post section vertically telescopic with respect to said lower post section for movement between first and second positions, connector means carried by said upper post section and connectable to a game net for disposing said net in a playing position when said upper post section is in said first position and for disposing said net in a non-playing position when said upper post section is in second position, actuator means including gear means comprising a rack and pinion for shifting said upper post section upwardly with respect to said lower post section to said first position from said second position, releasable means for holding said upper post section in said first position, and coin controlled timer means for releasing said releasable means to allow movement of said upper post section to said second position, wherein the improvement comprises:

said actuator means further including a drive shaft, hand crank means for driving said drive shaft, an intermediate shaft, reduction gear means interposed between said drive shaft and said intermediate shaft, a final drive shaft carrying said pinion, and reduction gear means interposed between said intermediate shaft and said final drive shaft.

4. A game net support comprising a lower tubular post having means at its lower end connectable to a stub-post adjacent to a game court, an upper tubular post telescopically disposed in said lower post, connector means for connecting an end of a game net to the upper end of said upper post, actuator means for shifting said upper post upwardly with respect to said lower post, releasable holding means for retaining said upper post in an upper position, coin controlled timer means cooperable with said holding means to release the same after a preset period of time and a cable in said upper post section, said cable being connected at one of its ends to the top of said upper post section, said cable having said connector means at its other end, a pulley rotatably supported within said lower post section, and said cable having an intermediate length extending downwardly around said pulley and upwardly to its connection with said upper post section.

5. In a support for a game net for use on a game court, said support including a post having a lower section adapted to be fixedly mounted on the court, an upper post section vertically telescopic with respect to said lower post section for movement between first and second positions, connector means carried by said upper post section and connectable to a game net for disposing said net in a playing position when said upper post section is in said first position and for disposing said net in a non-playing position when said upper post section is in said second position, actuator means carried by said lower post section and operable on said upper post section for moving said upper post section to said first position from said second position, releasable means for holding said upper post section in said first position, and coin controlled timer means for releasing said releasable means to allow movement of said upper post section to said second position, the improvement comprising:

said upper post section having a roller mounted thereto for vertical displacement therewith, and said lower post section having a roller vertically spaced from said roller mounted to said upper post section, said connector means including a cable extending about said roller mounted to said upper post section, and said cable having an end connected to said upper post section for movement therewith and having an intermediate portion of said cable extending about said roller in said lower post section.

6. Support apparatus for use with a game net including vertically extending post means formed for mounting proximate the playing area of a game court, connector means formed for connection to said game net and mounted to said post means for support of said game net by said post means with one of said game net and said connector means extending laterally away from said post means at a predetermined height above said game court, said connector means being mounted to said post means for selective movement, when connected to said game net, in a manner causing tensioning and relaxation of said game net, actuator means operatively connected to said connector means and formed for movement of said connector means to move said game net to and from a playing position and a non-playing position, and timer means operatively connected to said connector means and formed to control motion of said connector means, wherein the improvement in said support apparatus comprises:

said connector means being mounted with respect to said post means for selective vertical displacement of the height at said post means above said game court at which one of said game net and said connector means extends laterally away from said post means, said connector means being further mounted to said post means for movement to cause tensioning and relaxing of said game net in combination with said vertical displacement.

7. A support apparatus for a game net as defined in claim 6 wherein, said post means includes a post section movably mounted to the remainder of said post means, and said connection means is connected to said post section in a manner simultaneously effecting tensioning and relaxing of game net and effecting vertical displacement at said post means of one of said connector means and said game net upon movement of said post means.

8. A support apparatus for a game net as defined in claim 7 wherein, said post section is slideably mounted to the remainder of said post means.

9. A support apparatus for a game net as defined in claim 7 wherein, said game net is supported from said post means by a generally horizontally extending net supporting line, said connection means includes a cable formed for connection to said net supporting line, and said cable is connected to a supporting element carried by said post section for vertical movement therewith to determine the height at which said line is supported above said game court and to enable simultaneous tensioning and relaxation of said game net while said line is vertically displaced.

10. A method of supporting a game net proximate the playing area of a game court, said method including the steps of, raising said game net including an upper edge thereof to a playing position above the game court by applying a tensioning force to said game net by support apparatus having means for supporting said upper edge of said game net, holding said game net in said playing position for a predetermined time period, and automatically lowering said game net to a non-playing position by relaxing said tensioning force in said game net after said time period, wherein the improvement in said method comprises:

vertically displacing said means for supporting said upper edge of said game net at said support apparatus during application of said tensioning force to said game net and during relaxation of said tensioning force in said game net whereby raising and lowering of said game net is accomplished by a combination of vertical displacement of said game net at said support apparatus and tensioning and relaxation.

11. The method of supporting a game net proximate a game court as defined in claim 10 herein, said means for supporting said upper edge of said game net is provided by a vertically movable section connected to a horizontally extending game net supporting line, said vertically movable section being mounted to the remainder of said support apparatus to effect the step of vertical displacement by varying the height at which said line is positioned above said game court at said support apparatus, and the application of tensioning forces is accomplished by upwardly displacing said vertically movable section while the relaxation of said tensioning forces is accomplished by downwardly displacing said vertically movable section.

12. The method of claim 10 wherein said vertical displacement and said application or relaxation of tensioning force take place substantially simultaneously.

13. In a support for a game net for use on a game court, said support including a post having a lower section adapted to be fixedly mounted on the court, an upper post section vertically telescopic with respect to said lower post section for movement between first and second positions, connector means carried by said upper post section and connectable to a game net for disposing said net in a playing position when said upper post section is in said first position and for disposing said net in a non-playing position when said upper post section is in said second position, actuator means carried by said lower post section and operable on said upper post section for moving said upper post section to said first position from said second position, releasable means for holding said upper post section in said first position, and coin controlled timer means for releasing said releasable means to allow movement of said upper post section to said second position, the improvement comprising:

said actuator means including gear means comprising a rack and pinion for shifting said upper post section upwardly with respect to said lower post section, hand crank means for driving said gear means, and one-way clutch means for effecting the drive of said gear means between said hand crank and said rack and pinion only for effecting upward movement of said upper post section.

14. A support for a game net for use on a game court, said support including a post having a lower section adapted to be fixedly mounted on the court, an upper post section vertically telescopic with respect to said lower post section for movement between first and second positions, connector means carried by said upper post section and connectable to a game net for disposing said net in a playing position when said upper post section is in said first position and for disposing said net in a non-playing position when said upper post section is in said second position, actuator means including gear means comprising a rack and pinion for shifting said upper post section upwardly with respect to said lower post section to said first position from said second position, releasable means for holding said upper post section in said first position, and coin controlled timer means for releasing said releasable means to allow movement of said upper post section to said second position, wherein the improvement comprises:

said actuator means further including a drive shaft, hand crank means for driving said drive shaft, an intermediate shaft, reduction gear means interposed between said drive shaft and said intermediate shaft, a final drive shaft carrying said pinion, and reduction gear means interposed between said intermediate shaft and said final drive shaft.

15. A support for a game net as defined in claim 14 and said releasable means comprising a pawl normally biased into engagement with a gear of said gear means to prevent rotation of said gear in one direction, said timer means disengaging said pawl from said gear upon expiration of a preset time.

16. A support for a game net as defined in claim 15, wherein said pawl is normally biased into engagement with a gear on said intermediate shaft to prevent rotation of said gear in one direction, said timer means disengaging said pawl from said gear upon expiration of a preset time.

17. A game net support including a tubular lower post, a tubular upper post telescopically disposed in said lower post, connector means for connecting an end of a game net to the upper end of said upper post and to said lower post, actuator means for shifting said upper post upwardly with respect to said lower post, releasable holding means for retaining said upper post in an upper position, and coin controlled timer means cooperable with said holding means to release the same after a preset period of time wherein the improvement in said net support comprises:

said lower post having means at its lower end connectable to a stub-post adjacent to a game court, and said connector means is connected to said upper post and said lower post to cause the combination of upward displacement of the height of said game net above said game court at said upper post and tensioning of said game net upon shifting said upper post upwardly.

18. A game net support as defined in claim 17, including a cable in said upper post section, said cable being connected at one of its ends to the top of said upper post section, said cable having said connector means at its other end, a pulley rotatably supported within said lower post section, and said cable having an intermediate length extending downwardly around said pulley and upwardly to its connection with said upper post section.

* * * * *